US005928052A

United States Patent [19]

Buscher

[11] Patent Number: 5,928,052

[45] Date of Patent: Jul. 27, 1999

[54] CUBE TOY BLOCKS

[76] Inventor: William C. Buscher, 13 Arcadia Ct., Sloatsburg, N.Y. 10974

[21] Appl. No.: 09/078,701

[22] Filed: May 14, 1998

[51] Int. Cl.[6] ..... A63H 33/08; A63H 33/06; A63H 33/12

[52] U.S. Cl. ..... 446/124; 446/122; 446/118

[58] Field of Search ..... 446/85, 105, 116, 446/122, 124

[56] References Cited

U.S. PATENT DOCUMENTS

| | | | |
|---|---|---|---|
| 370,958 | 10/1887 | Loos | 446/105 |
| 1,894,605 | 4/1933 | Wright | 446/122 |
| 3,546,792 | 12/1970 | Sherman | 434/96 |
| 3,747,261 | 7/1973 | Salem | 446/104 |
| 4,143,481 | 3/1979 | Loechel | 446/122 |
| 4,676,762 | 6/1987 | Ballard | 446/104 |

FOREIGN PATENT DOCUMENTS

| | | | |
|---|---|---|---|
| 969980 | 7/1948 | France | 446/124 |
| 1145586 | 10/1957 | France | 446/105 |
| 1213036 | 11/1970 | United Kingdom | 446/124 |
| 2105998 | 4/1983 | United Kingdom | 446/122 |

*Primary Examiner*—Robert A. Hafer
*Assistant Examiner*—Kurt Fernstrom
*Attorney, Agent, or Firm*—Richard A. Joel, Esq.

[57] ABSTRACT

The set of blocks in this invention comprise "slot blocks" and "key blocks." A slot block is a cube having two slots on each face. Each slot crosses the entire face and bisects a pair of opposite edges. The cross section of each slot is a square whose width and depth are one-fifth the length of the edge of the cube. A key block is a rectilinear polygon whose thickness is equal to the slot width and depth. Each side of each polygon has a length that is a whole number multiple of the slot width and depth. The shapes of the key blocks are such that they can completely fill all the slots, internal and external, of an aligned stack of slot blocks, with the external key blocks forming continuous intersecting ridges whose width and height are equal to the slot width and depth. The key blocks, with or without the slot blocks, also lend themselves to the construction of other attractive forms that would be rarely, if ever, realized with other block sets.

7 Claims, 8 Drawing Sheets

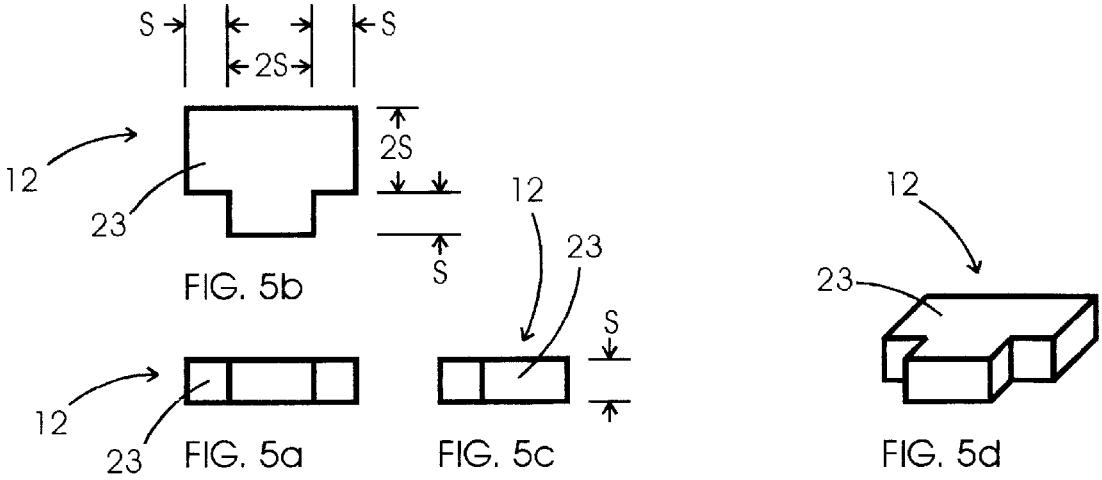
S
2S
S
12
23
2S
S
FIG. 5b
12
23
S
12
23
FIG. 5a
FIG. 5c
FIG. 5d
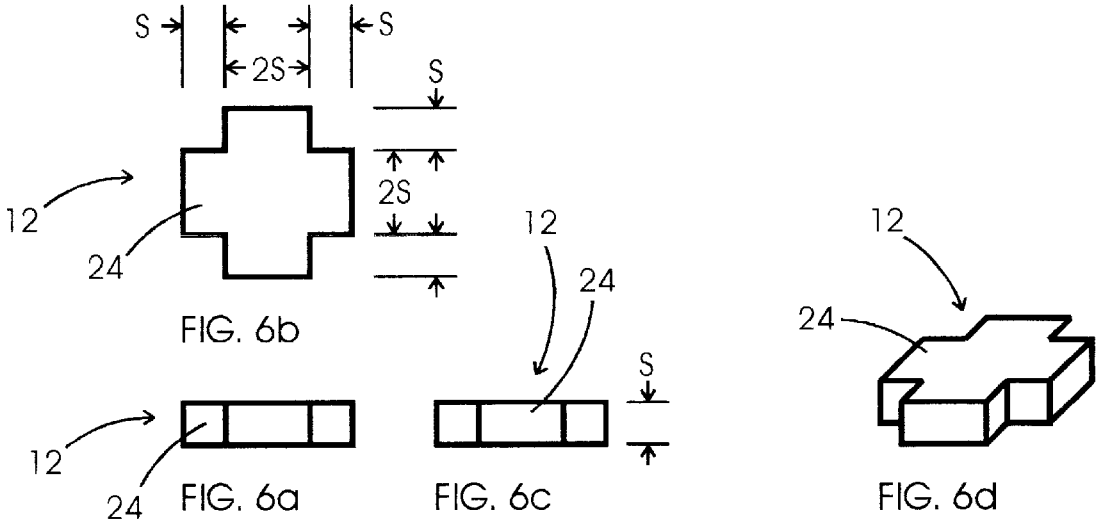
S
2S
S
S
12
24
2S
FIG. 6b
12
24
S
12
24
FIG. 6a
FIG. 6c
FIG. 6d
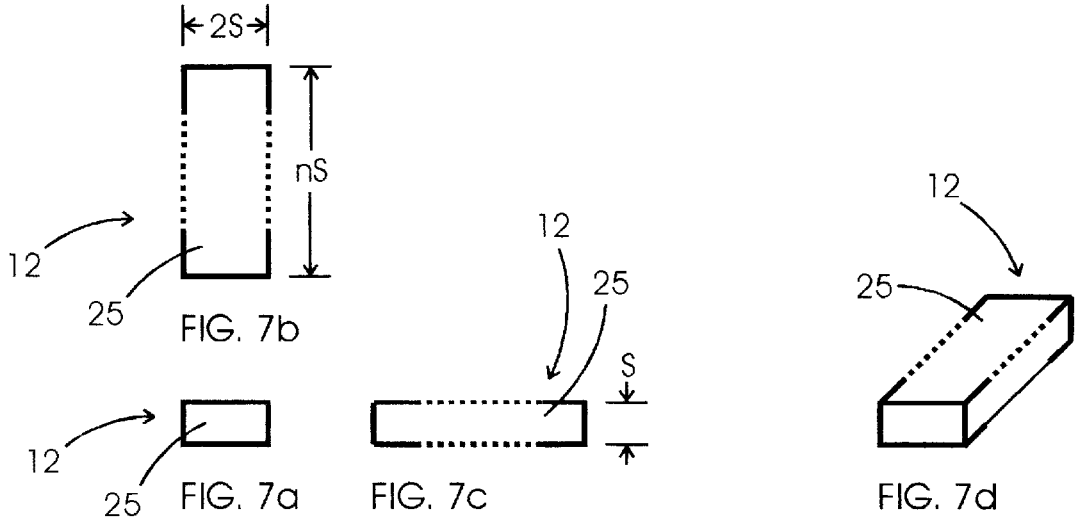
2S
nS
12
25
FIG. 7b
12
25
S
12
25
FIG. 7a
FIG. 7c
FIG. 7d

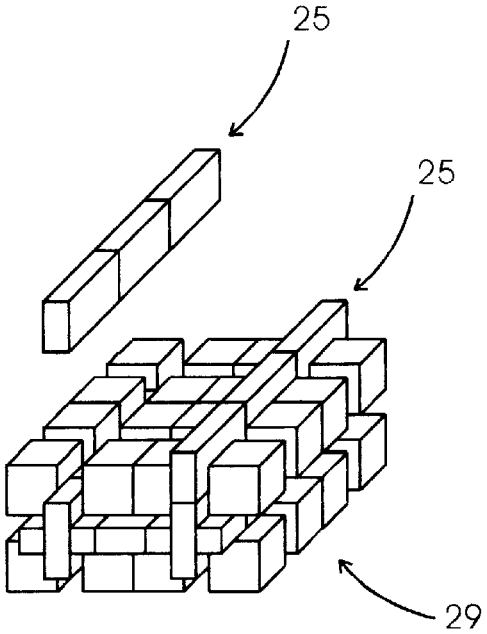
FIG. 11
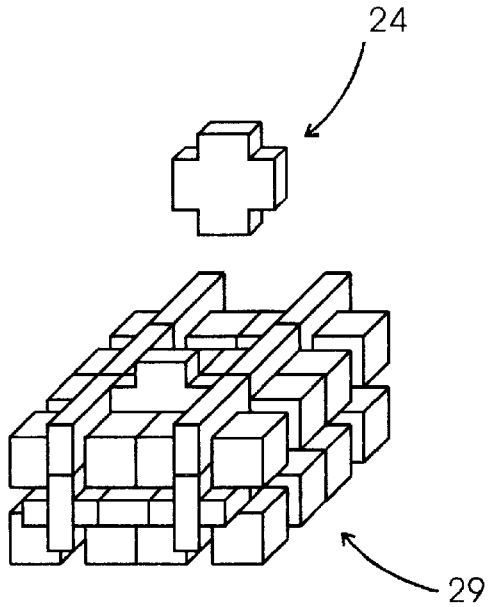
FIG. 12
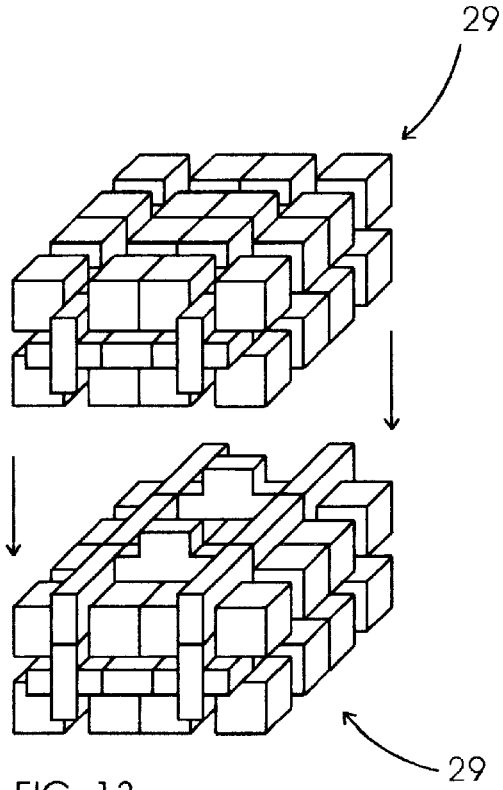
FIG. 13
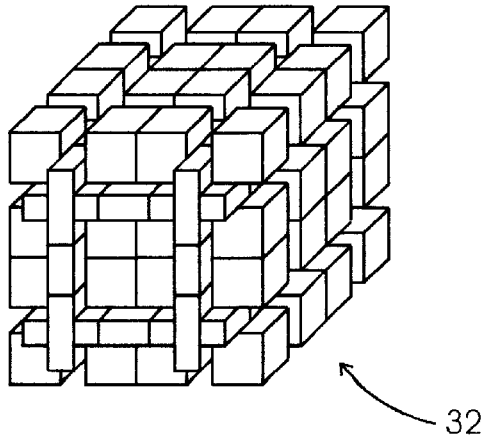

30a

30b

30c

30d

30e

30f

30i

30g

30h

30k

30j

CUBE TOY BLOCKS

BACKGROUND OF THE INVENTION

This invention is concerned with play building blocks in modular form comprising what can be considered an intriguing puzzle or a challenging toy construction set. In addition, the details of the structure may have application to full sized building construction. The invention includes a number of distinct structural modular blocks which can be assembled to each other to create structures that are of interest theoretically and may also be utilitarian structures. The blocks of the present invention are designed so that they may be interlocked in a variety of shapes and assemblies including a basic cube employing a full set of block components or a series of substructures. The blocks are dimensioned so that they fit together and stay together due both to the structural shape and the close tolerances. Preferably they are constructed of wood that is dimensionally stable over a wide range of temperature and moisture conditions. The blocks have relatively simple structured shapes which are all based on cubic shapes. The blocks include sides which are 90° in multiples thereof to each other and all sides are planar. From an entertainment or teaching point of view, the blocks probably could be disassembled and assembled by children ages six and up, however, younger users can enjoy making basic formations and matching block surfaces, shapes and the like.

In addition to the intellectual and problem solving challenges inherent in the synthesizing of structures utilizing a variety of geometric shapes, the blocks are particularly useful in developing dexterity because of the preciseness and relatively close tolerance of the dimensions utilized to assure stability of the assembled object. There are innumerable basic geometric configurations which can be constructed that are generally referred to as polyhedrons.

The present set of blocks overall comprise various rectangular and square parallelepiped blocks. Preferably such blocks will be comprised of wood. Cheaper versions or larger versions may be constructed of relatively inexpensive plastic such as polyethylene, polypropelene. The blocks, of course can be made in multiple colors or the same or different hues within the same set to add visual interest to the resulting structures. Optionally different shaped pieces can be supplied with different colors so that the different shapes or configurations are, in effect, color coded, making the assembly easier particularly for younger children.

The prior art of construction or building blocks is replete with different shaped blocks and different ways of holding blocks together such as Tinker Toys™ and Legos™ and those versions shown in the prior references discussed below. It is common that the most successful toy construction sets or building block sets are also the neatest and the most discrete and elegant such as Lego™ and Lincoln Logs™. Such sets have unique structural features, but are all basically of simple repetitive design components making for ease of manufacture and ease of learning, while providing a virtually inexhaustible number of variations in the assemblage. The same is true in the present invention with the basic number of different structural shapes of parallelepiped block construction with right angles and straight sides and flat surfaces. These shapes provide an unparalleled number of assembly relationships and structures all within the context of manufactured structures with flat surfaces all at right angles to each other and of solid configuration. These toy blocks are all of modular construction. Rectangular sub-blocks are included with each flat dimension being a whole number multiple of the smallest external dimension of any surface. Slots, recesses and cubes are integer multiples of the basic smallest sub-block dimension. Each block is of integral one-piece construction that can be combined in a wide variety of combinations to create many utilitarian and/or decorative structures as desired by the user.

The blocks can be assembled into a variety of repeating of random non-repeating structural patterns limited only by the imagination of the designer of the structure and the number of available blocks in the set. The frictional interference and dimensional fits between the individual blocks aids the self-supporting structures that are readily created.

As indicated, the blocks can be formed from a variety of materials as integral cut, cast or molded units that can be solid or hollow and made from plastic, wood, metal, and the like.

The closest prior art references of which the applicant is aware are as follows:

U.S. Pat. No. 3,747,261—Salem discloses a ball and socket linkage for connecting polyhedral members. In this patent, the center 1 might be considered somewhat analogous to the central slot block in that the slots contain balls connected by spheres which are in turn connected by cross-member 40, 41.

In an earlier patent, U.S. Pat. No. 1,281,856—Shaw the central blocks shown in FIG.1 are a cubical outline with crisscrossing grooves integrally formed therein which is somewhat analogous to a slot block. Also of interest is the toy building block kit and component pieces shown in U.S. Pat. No. 4,676,762—Ballard wherein the core blocks or slot blocks have a general similarity to a slot block.

Of general background interest, the following reference each relate to a combined structure for toy blocks: U.S. Pat. No. 4,990,116—Chen; U.S. Pat. No. 4,699,602—Giorgi; U.S. Pat. No. 3,838,535—Larws. Finally, U.S. Pat. No. 5,575,120—Handley is of general interest showing a system of interlocking construction blocks.

In the present invention which differs from the prior art, there are two basic types of blocks-slot blocks which are core or main building components and key blocks. The slot blocks are all the same shape, that is, a cube with two intersecting grooves on each face. Each groove crosses the entire face and bisects a pair of opposite edges. The cross-section of each groove is a square whose side is a length that is one-fifth the length of the edge of the overall cube. There are five shapes of what can be referred to as key blocks, each of which is a rectilinear polygon which has a thickness equal to the width of the grooves in the slot block. The other dimensions of the polygon are a multiple of the groove width. The five shapes are: rectangles of various length, corner blocks, tee blocks, cee blocks, and cross blocks.

SUMMARY OF THE INVENTION

This invention relates to construction blocks and particularly to block sets comprised of slot blocks and key blocks which may be assembled into a block set or in any combination into unique designs.

A slot block is a cube having two slots on each face. Each slot crosses the entire face and bisects a pair of opposite edges. The cross-section of each slot is a square whose width and depth are one-fifth the length of the edge of the cube.

A key block is a rectilinear polygon whose thickness is equal to the slot width and depth. Each side of each polygon has a length that is a whole-number multiple of the slot width and depth. The shapes of the key blocks are such that they can completely fill all the slots, internal and external, of an aligned stack of slot is blocks, with the external key blocks forming continuous intersecting ridges whose width and height are equal to the slot width and depth. The key blocks, with our without the slot blocks, also lend themselves to the construction of other attractive forms that would be rarely realized with other block sets.

Accordingly, it is an object of this invention to provide a new and improved set of blocks.

Another object of this invention is to provide new and improved play building blocks in modular form.

A further object of this invention is to provide a new and improved set of blocks comprising slot blocks and key blocks.

A more specific object of this invention is to provide a new and improved construction set of slot blocks comprising a cube having two slots on each face, the cross-section of which is a square whose width and depth are one-fifth the length of the cube and key blocks of various shapes which fill the slots to form a unique and intriguing construction.

BRIEF DESCRIPTION OF THE DRAWINGS

The above and other objects and advantages of this invention may be more clearly seen when viewed in conjunction with the accompanying drawings wherein:

FIGS. 5*a*–5*d* shows a key block namely, the "tee" block in respectively, front, top, side and perspective views;

FIGS. 6*a*–6*d* shows a key block namely, the "cross" block in respectively, front, top, side and perspective views;

FIGS. 7*a*–7*d* shows a key block namely, the "straight" block in respectively, front, top, side and perspective views;

FIG. 11 illustrates assembly step 4, namely, adding straight blocks to the lower half stack;

FIG. 12 illustrates assembly step 5, namely, adding cross blocks to the lower half stack;

FIG. 13 illustrates assembly step 6, namely, fitting the upper half stack to the lower half stack;

DETAILED DESCRIPTION OF THE INVENTION

Figure 1:
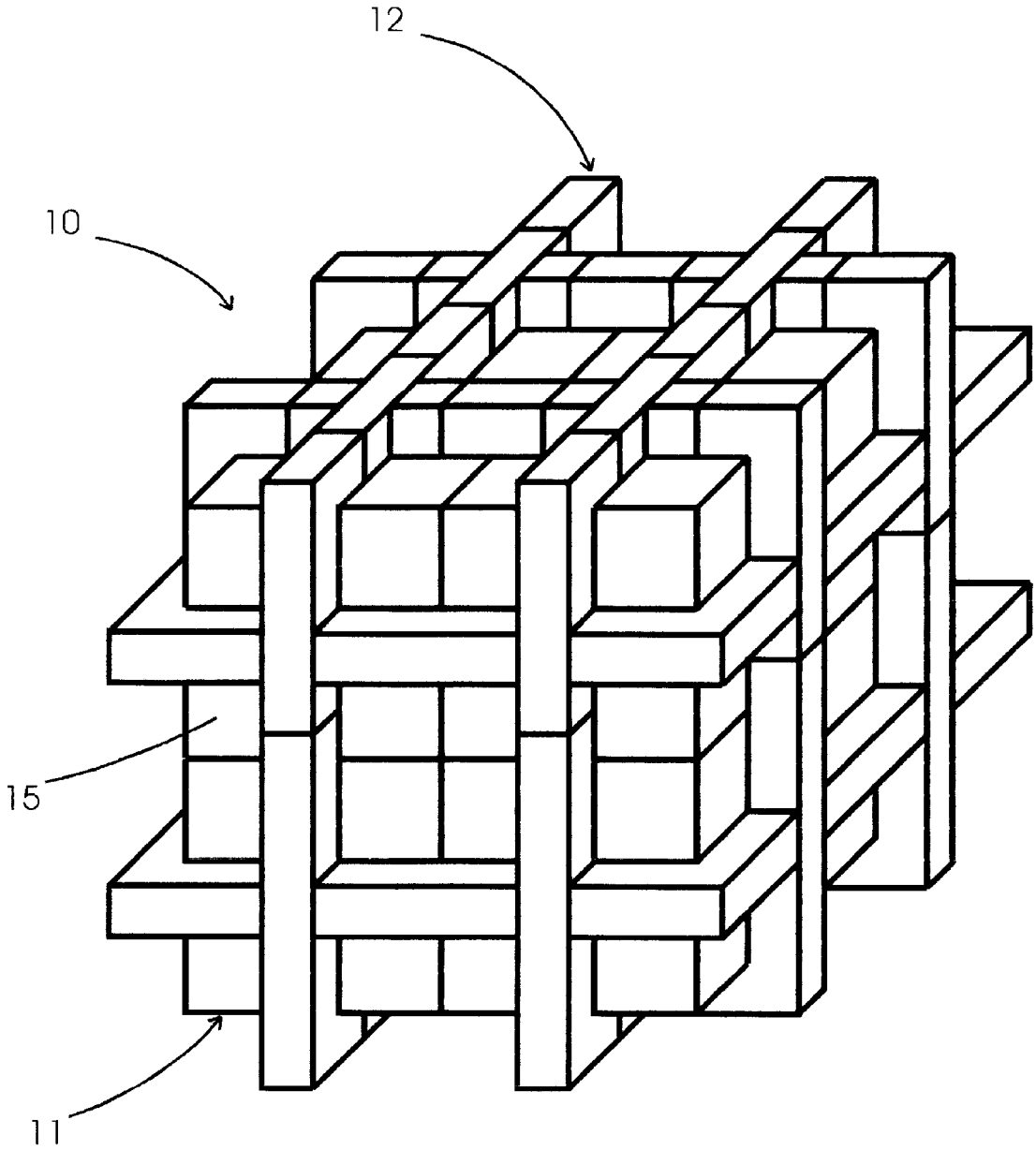
FIG. 1 illustrates an aligned stack of slot blocks with all internal and external slots filled with key blocks.

Referring now to the drawings, this invention relates to blocks and more particularly to construction blocks used to build various play and useful structures. The blocks described here are designed to be assembled into a stack 10 having the shape of a parallelepiped that is encircled by square ridges. FIG. 1 shows such a stack 10.

The blocks in the stack 10 consist of "slot blocks" 11 and "key blocks" 12. A slot block 11 is a cube having two slots 13*a* and 13*b* and 14*a* and 14*b* on each face 15. Each slot 13*a*, 13*b* or 14*a*, 14*b* crosses the entire face 15 and bisects a pair of opposite edges. The cross section of each slot is a square whose width and depth are equal to one-fifth the length of the edge of the cube.

A key block 12 is a rectilinear polygon whose thickness is equal to the slot 13*a*, 13*b*, 14*a*, 14*b* width and depth. Each side of each polygon has a length that is a whole-number multiple of the slot width and depth.

The dimensions of the slot blocks 11 and the key blocks 12 are adjusted as needed to permit the key blocks 12 to be inserted easily into the slots 13*a*, 13*b*, 14*a* 14*b* of the slot blocks 11. When the key blocks 12 are inserted within an assembly of slot blocks 11, they serve to hold the assembly together. When inserted around the outside of an assembly of slot blocks 11, they serve to ornament the assembly.

Figure 2A:
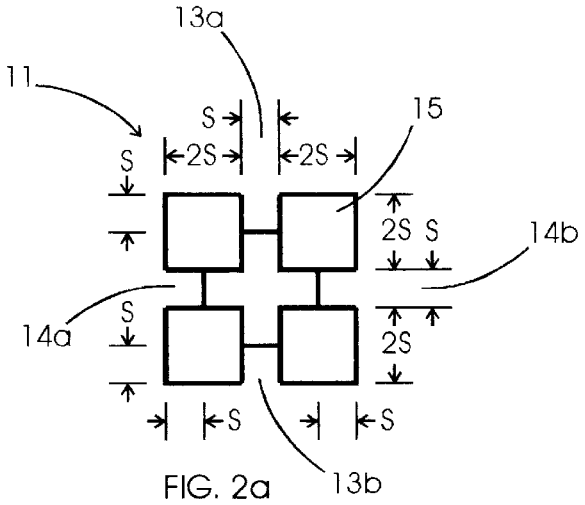
FIG. 2*a* shows a front view of a slot block and FIG. 2*b* shows a perspective view of a slot block.
Figure 2B:
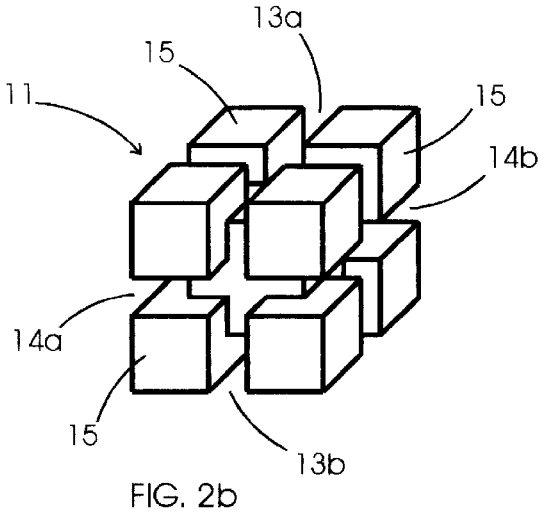
Figure 3B:
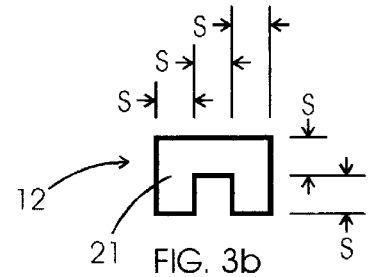
FIGS. 3*a*–3*d* shows a key block namely, the "cee" block in respectively, front, top, side and perspective views.
Figure 3A:
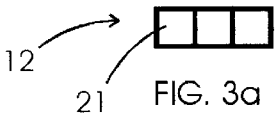
Figure 3C:
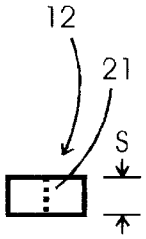
Figure 3D:
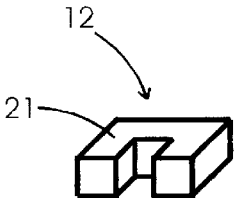
Figure 4B:
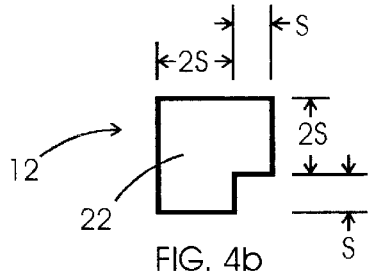
FIGS. 4*a*–4*d* shows a key block namely, the "corner" block in respectively, front, top, side and perspective views.
Figure 4A:
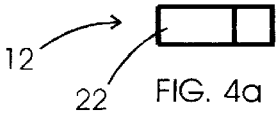
Figure 4C:
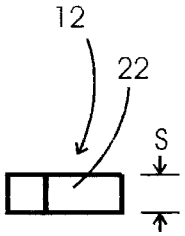
Figure 4D:
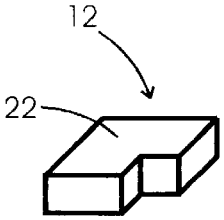
Figure 8:
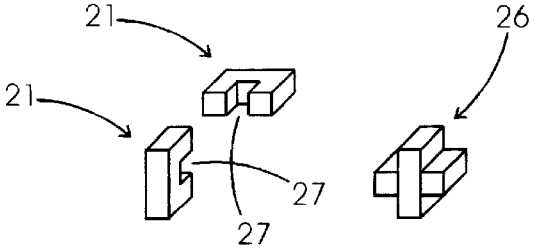
FIG. 8 illustrates assembly step 1, namely, combining cee blocks into cee pairs.

FIGS. 2*a* through 7*d* show the various shapes of the slot blocks 11 and the key blocks 12. All dimensions are given as multiples of "s", where "s" is the slot width and depth. FIG. 2*a* shows a slot block 11 as a cube having two slots 13*a*, 13*b* and 14*a*, 14*b* on each face 15. Each slot crosses the entire face 15 and bisects a pair of opposite edges. The cross section of each slot is a square whose width and depth are equal to one-fifth the length of the edge of the cube.

FIGS. 3*a*–3*d* illustrate a type of key block 12 known as a "cee" block 21 (shaped somewhat like the letter "C") which is a 2s-by-3s rectangle from which a 1s-by-1s square has been removed from the middle of one of the longer sides.

FIGS. 4*a*–4*d* illustrate a type of key block 12 known as a "corner" block 22 which is a 3s-by-3s square polyhedron from which a 1s-by-1s square has been removed from one corner.

FIGS. 5*a*–5*d* illustrate a type of key block 12 known as a "tee" block 23 (shaped somewhat like the letter "T") which is 3s-by-4s rectangular polyhedron from which a 1s-by-1s square has been removed from the two ends of one of the longer sides.

FIGS. 6*a*–6*d* illustrate a type of key block 12 known as a "cross" block 24 which is a 4s-by-4s square polyhedron from which a 1s-by-1s square has been removed from each corner.

FIGS. 7*a*–7*d* illustrate a type of key block 12 known as a "straight" block 25 which is a 2s-by-ns rectangular polyhedron where "n" may be any whole number.

The stack 50 shown in FIG. 1 is built from a set that contains 8 slot blocks; 24 cee blocks; 8 corner blocks; 8 tee blocks; 2 cross blocks; 12 straight blocks (length 4s); 8 straight blocks (length 5s); and 8 straight blocks (length 7s).

FIGS. 8 through 17 show how the stack 10 is assembled. Firstly, join the twenty-four cee blocks 21 into twelve cee pairs 26. To make a cee pair 26, press two cee blocks 21 together so that each fits into the notch 27 of the other. The resulting cee pair 26 is a cross that is 2s thick. (See FIG. 8).

Figure 9:
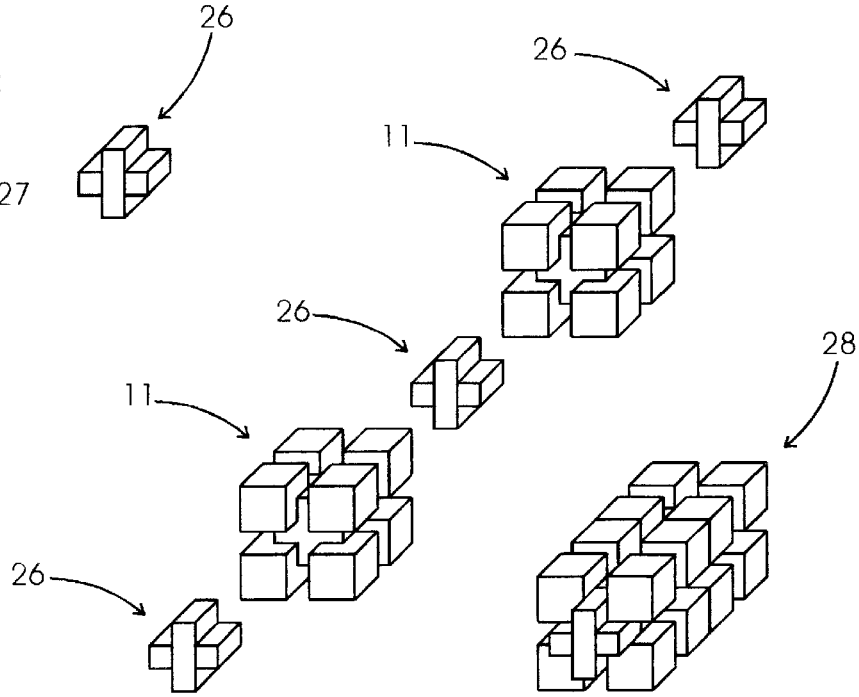
FIG. 9 illustrates assembly step 2, namely, combining slot blocks and cee pairs into slot block pairs.

Next, as shown in FIG. 9 join the eight slot blocks 11 into four slot-block pairs 28. To make a slot-block pair 28, press two slot blocks together over a cee pair 26. Press a cee pair 26 into each end of each slot-block pair 28.

Figure 10:
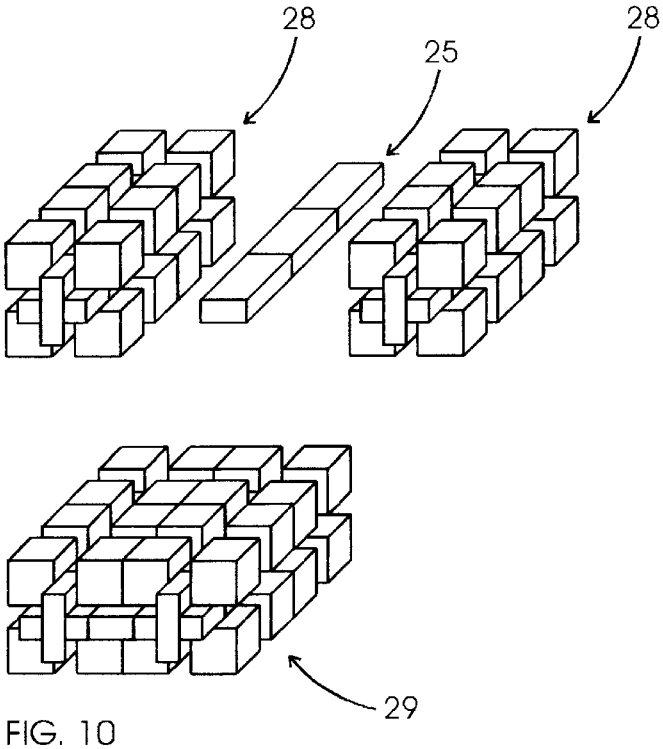
FIG. 10 illustrates assembly step 3, namely, combining slot-block pairs and straight blocks into half stacks.

Next, as shown in FIG. 10, join the four slot block pairs 28 into two half stacks 29. To make a half stack 29, press two slot-block pairs 28 together lengthwise over three aligned 4s straight blocks 25. Align the protruding ends of the straight blocks with the protruding ends of the cee pairs 28.

As shown in FIG. 11, turn each half stack 29 so that the front and back surfaces contain the protruding cee pairs 26. One half stack 29 will be the bottom half and the other will be the top half. Press three 4s straight blocks 25 into each front-to-back groove on the top surface of the bottom half stack 29.

As shown in FIG. 12, press the two cross blocks 24 into the center of each left-to-right groove on the top surface of the bottom half stack 29.

As shown in FIG. 13, press the top half stack 29 down onto the bottom half stack to obtain stack 32.

Figure 14:
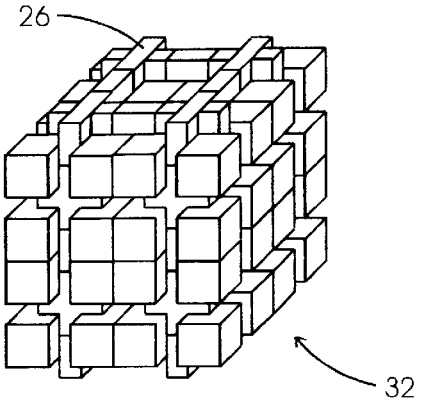
FIG. 14 illustrates assembly step 7, namely, turning the full stack so that the protruding cee pairs are at the top and the bottom.

As shown in FIG. 14, turn the full stack 32 so that the top and bottom surfaces contain the protruding cee pairs 26.

Figure 15:
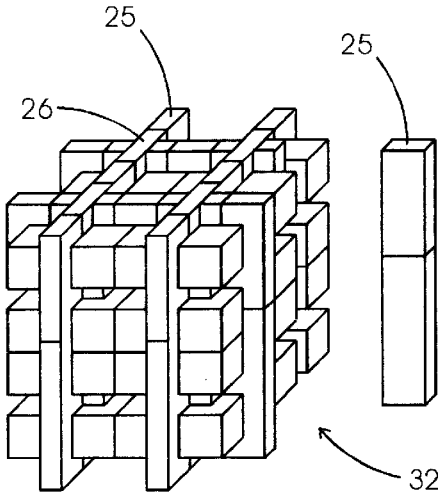
FIG. 15 illustrates assembly step 8, namely, inserting straight blocks into the vertical slots.

Next, as shown in FIG. 15, press a 5*s* straight block and a 7s straight block 25 into each of the eight vertical slots. Align the protruding ends of the straight blocks 25 with the protruding ends of the cee pairs 26.

Figure 16:
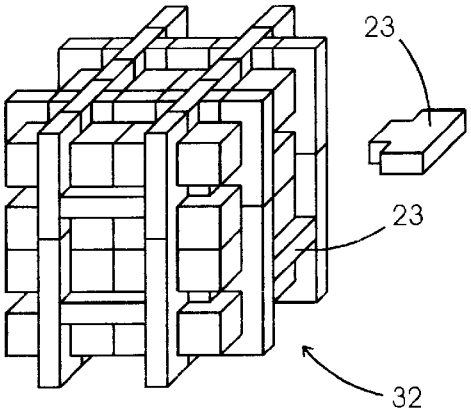
FIG. 16 illustrates assembly step 9, namely, inserting a tee block into the middle of each horizontal slot.

Press a tee block 23 into the center of each of the eight horizontal slots as shown in FIG. 16.

Figure 17:
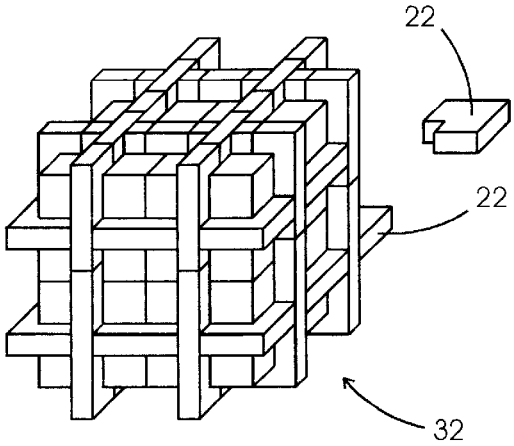
FIG. 17 illustrates assembly step 10, namely, inserting a corner block into each corner slot.

Press a corner block 22 into each of the eight corner slots as shown in FIG. 17. This completes the assembly.

The blocks 11 and 12 comprising a stack 10, can be played with in various ways. It is anticipated that children will enjoy:

1. Disassembling the stack 10. Disassembly is not meant to be difficult. The stack 10 is not meant to be a puzzle. The stack 10 is, however, meant to be surprising in the number and variety of its components.

Figure 18A:
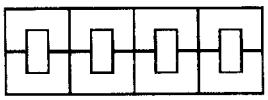
FIG. 18*a*–*k* illustrate two dimensional designs that can be made with the key blocks from an eight-slot-block set; and, FIG. 19*a*–*k* illustrate three dimensional structures that can be made with the slot blocks and key blocks from an eight-slot-block set.
Figure 18B:
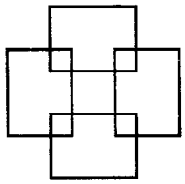
Figure 18C:
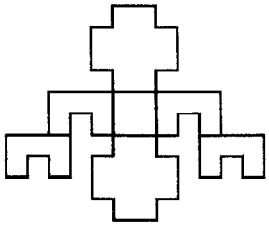
Figure 18D:
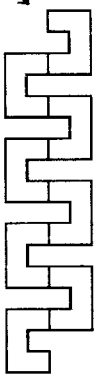
Figure 18E:
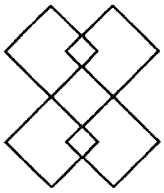
Figure 18F:
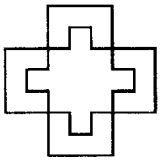
Figure 18I:
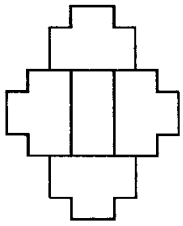
Figure 18G:
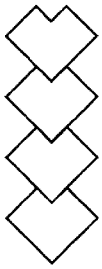
Figure 18H:
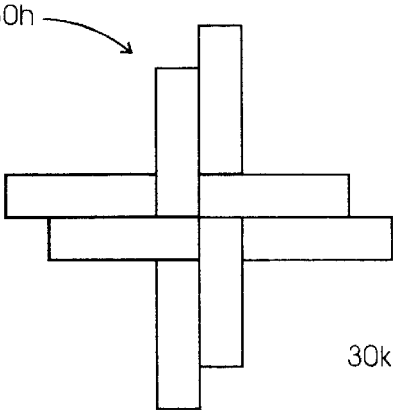
Figure 18K:
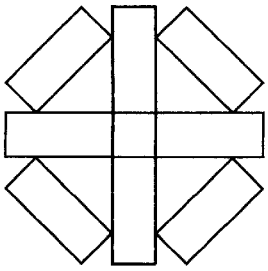
Figure 18J:
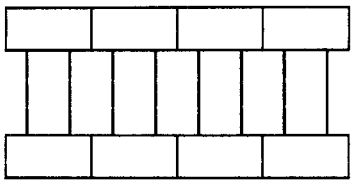
Figure 19A:
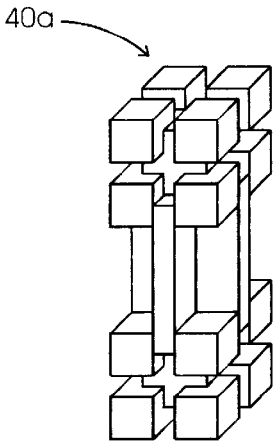
Figure 19B:
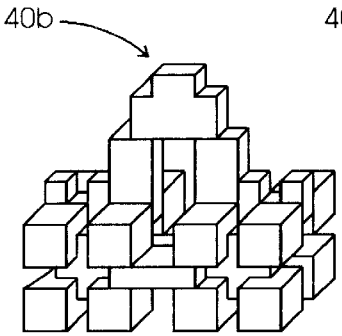
Figure 19C:
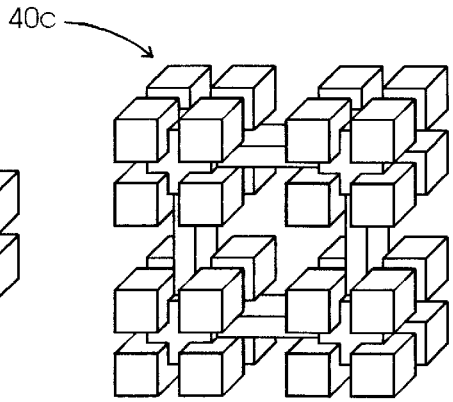
Figure 19D:
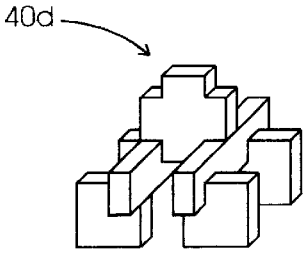
Figure 19E:
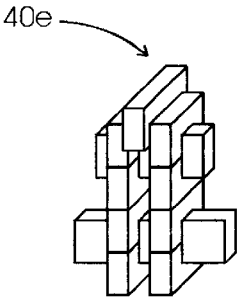
Figure 19F:
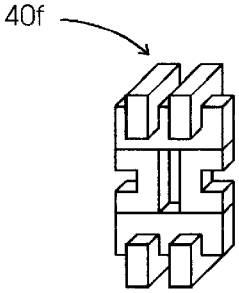
Figure 19G:
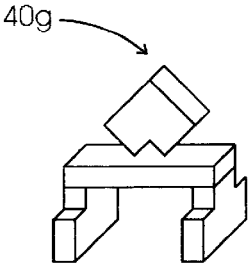
Figure 19H:
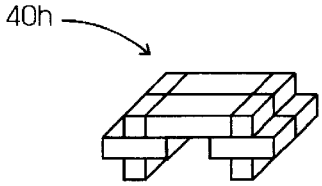
Figure 19I:
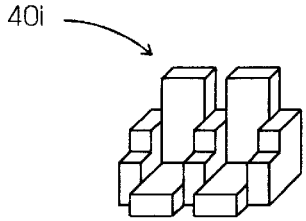
Figure 19J:
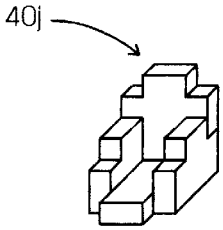
Figure 19K:
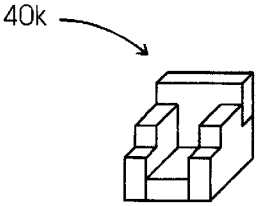

2. Making two dimensional designs. FIGS. 18*a*–18*b* show a set of two dimensional designs 30*a–k* assembled from the key blocks 12 in the stack 10 (FIG. 1)

3. Making three dimensional structures. FIGS. 19*a*–19*k* show a set of three-dimensional structures 40*a–k* assembled from the key blocks 11 and slot blocks 12 in the stack 10 (FIG. 1)

4. Reassembling the stack 10. The task can be broken down into simple subtasks that children can master.

While the invention has been explained by a detailed description of certain specific embodiments, it is understood that various modifications and substitutions can be made in any of them within the scope of the appended claims which are intended also to include equivalents of such embodiments.

What is claimed, is:

1. A set of toy blocks comprising:

a plurality of slot blocks each comprising a cube having a plurality of faces and two slots on each face having a predetermined width and depth, said slots crossing the entire face;

a plurality of key blocks each comprising a rectilinear polygon having a thickness equal to the slot width and depth wherein;

said slot blocks are joined by key blocks mounted within the slots in the slot blocks and wherein;

the key blocks comprise a plurality of shapes which fill all the slots both internal and external of an aligned stack of slot blocks, said external key blocks forming continuous intersecting ridges equal to the slot width and depth.

2. A set of blocks in accordance with claim 1 wherein:

the key block comprises a rectilinear polygon having sides which are a whole number multiple of the slot width and depth.

3. A set of blocks in accordance with claim 1 including:

a first and a second key block having upper and lower legs and a base, said legs being perpendicular to the base to form a "C" configuration joined together to form a cross configuration wherein a first and a second slot block are assembled into a slot block pair by coupling said slot blocks with the cross key configuration.

4. A set of blocks in accordance with claim 1 further including:

a plurality of aligned key blocks having a polygon configuration and slot block pairs wherein the key blocks couple the slot blocks by insertion into adjacent slots to form a half-stack.

5. A set of blocks in accordance with claim 4 including:

a first and a second half-stack wherein said half-stacks are coupled together by key blocks to form a full-stack of blocks.

6. A set of blocks in accordance with claim 1 wherein:

said block comprising a square cross block configuration polyhedron from which a square has been removed at each corner.

7. A set of blocks comprising:

a plurality of slot blocks, each comprising a cube having a plurality of faces having edges along their periphery and two slots each having a width and depth which is one-fifth the length of an edge; and, a plurality of key blocks each comprising a rectilinear polygon having a thickness equal to the slot width and depth wherein the slot blocks are joined by key blocks together forming internal and external slots, said internal slots being totally filled with the key blocks and the external slots being filled with key blocks to form continuous intersecting ridges having a width and depth equal to the slot width and depth thereby forming a unitary stack of slot blocks and key blocks.

* * * * *